US008766537B2

(12) United States Patent
Lamouri et al.

(10) Patent No.: US 8,766,537 B2
(45) Date of Patent: Jul. 1, 2014

(54) INFRARED HALOGEN LAMP WITH IMPROVED EFFICIENCY

(75) Inventors: Abbas Lamouri, Aurora, OH (US); Frederic Ahlgren, Highland Hts., OH (US); Juris Sulcs, Chagrin Falls, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 12/825,167

(22) Filed: Jun. 28, 2010

(65) Prior Publication Data

US 2010/0327729 A1 Dec. 30, 2010

Related U.S. Application Data

(60) Provisional application No. 61/220,872, filed on Jun. 26, 2009.

(51) Int. Cl.
*H01K 1/50* (2006.01)

(52) U.S. Cl.
USPC ..... 313/579; 313/491; 313/623; 313/631; 313/634

(58) Field of Classification Search
USPC ..... 313/484, 491, 493, 567, 623, 628, 573, 313/574, 579, 631, 634, 635, 318.02
See application file for complete search history.

(56) References Cited

U.S. PATENT DOCUMENTS

| | | | | |
|---|---|---|---|---|
| 3,385,993 | A | 5/1968 | Kimball | |
| 4,942,331 | A * | 7/1990 | Bergman et al. | 313/271 |
| 4,959,585 | A * | 9/1990 | Hoegler et al. | 313/271 |
| 5,087,218 | A | 2/1992 | Ahlgren et al. | |
| 5,140,217 | A * | 8/1992 | Rao et al. | 313/274 |
| 5,705,882 | A * | 1/1998 | Oughton | 313/112 |
| 5,962,973 | A * | 10/1999 | Rice | 313/580 |
| 6,313,582 | B1 * | 11/2001 | Miyanaga et al. | 313/623 |
| 2003/0127979 | A1 | 7/2003 | Weyhrauch et al. | |
| 2004/0150343 | A1 * | 8/2004 | Takahashi et al. | 313/623 |
| 2005/0092613 | A1 * | 5/2005 | Fridrich | 205/138 |
| 2005/0093454 | A1 * | 5/2005 | Fridrich | 313/634 |
| 2007/0262718 | A1 | 11/2007 | Aurongzeb et al. | |

* cited by examiner

*Primary Examiner* — Anh Mai
*Assistant Examiner* — Kevin Quarterman
(74) *Attorney, Agent, or Firm* — Duane Morris LLP

(57) ABSTRACT

Methods for improving the efficiency of infrared (IR) halogen lamps and IR halogen lamps having improved efficiency are disclosed. In a method of aligning a filament in a lamp body, the lamp body having the filament therein is rotated, and tubular end portions are heated and necked down which may assist in positioning the filament within the lamp and reduce end losses. IR halogen lamps formed from glass tubes having an OD less than 5 mm are also disclosed. The reduced diameter of the glass tubing increases the surface area for IR energy reflection and reduces end losses. Spuds or beads may be used to position the filament within the lamp.

11 Claims, 9 Drawing Sheets

INFRARED HALOGEN LAMP WITH IMPROVED EFFICIENCY

CLAIM OF PRIORITY

This application claims the priority of U.S. Provisional Patent Application No. 61/220,872 filed Jun. 26, 2009, the content of which is incorporated herein in its entirety by reference.

FIELD

The present subject matter pertains generally to infrared (IR) halogen lamps and more particularly to methods and apparatuses for increasing the efficiency of IR halogen lamps.

BACKGROUND

Double ended infrared (IR) halogen lamps generally comprise a quartz tube, a tungsten filament, and a fill gas comprising an inert gas such as xenon and at least one halogen gas. Such lamps require a well defined shaped bulb and a precisely aligned filament in order to achieve maximum efficiency of infrared energy collection. FIGS. 1A-B depict a known halogen lamp 107. Referring to FIG. 1A, a lamp body 102 is formed from a quartz tube 104 having an inside (inner) diameter ID and an outside (outer) diameter OD. A light emitting chamber 106 (bulb) is formed using techniques known to one of ordinary skill in the art. A chamber 106 has an exterior coating (not shown). As shown in FIG. 1B, a filament 110, which may be a tungsten filament, is positioned within the lamp body 102, with a coiled portion positioned within the chamber 106. Spuds 112*a-b* align the filament 110 on a longitudinal axis of the lamp body. FIG. 1B shows sealed portions 114*a-b* that result from sealing the end portions 108*a-b* after positioning the filament 110 within the lamp body.

The outer surface of the chamber 106 is coated with a multilayer film (not shown) that transmits visible radiation (visible light) and reflects IR radiation back to the filament 110. Such a film is described in, e.g., U.S. Pat. No. 6,476,556, by Cottaar. The reflected IR energy is reabsorbed by filament 110 to decrease the power required to operate the lamp 107 without reducing the visible radiation output, thus improving efficiency. The amount of reabsorbed IR energy is highly dependent on the radial alignment of the filament 110 along the longitudinal axis of the lamp 107. Reflected energy that misses the filament 110 and is not reabsorbed eventually leaks through the end portions 114*a-b*. Such end losses do not contribute to the conversion of IR energy to visible radiation.

SUMMARY

A method of aligning a filament in an electric lamp body includes providing a lamp body of light transmissive material. The lamp body includes a light emitting chamber intermediate first and second tubular end portions. A filament assembly having a refractory metal wire is provided. The filament assembly is positioned in the lamp body so that the wire extends from the light emitting chamber into each tubular end portion. The lamp body is rotated about its longitudinal axis. A portion of the first tubular end portion is heated and necked down so that the inside and outside diameter of the first tubular end portion is reduced as desired. The diameter of the end portion may be reduced sufficiently to assist in maintaining the position of the filament wire along the longitudinal axis of the lamp body. A portion of the second tubular end portion is heated and necked down so that the inside and outside diameter of the second tubular end portion is reduced as desired. The diameter of the end portion may be reduced sufficiently to assist in maintaining the position of the filament wire along the longitudinal axis of the lamp body.

A method of making an infrared (IR) halogen lamp includes providing a lamp body of light transmissive material. The lamp body includes a light emitting chamber intermediate first and second tubular end portions. The light emitting chamber is coated with an IR reflective coating. A filament assembly having a refractory metal wire is provided. The filament assembly is positioned in the lamp body so that the wire extends from the light emitting chamber into each tubular end portion. The lamp body is rotated about its longitudinal axis. A portion of the first tubular end portion is heated and necked down so that the inside and outside diameter of the first tubular end portion is reduced as desired. The diameter of the end portion may be reduced sufficiently to assist in maintaining the position of the filament wire along the longitudinal axis of the lamp body. A portion of the second tubular end portion is heated and necked down so that the inside and outside diameter of the second tubular end portion is reduced as desired. The diameter of the end portion may be reduced sufficiently to assist in maintaining the position of the filament wire along the longitudinal axis of the lamp body. The end portions are sealed and trimmed to a specified length. The light emitting chamber may be coated before or after the end portions are sealed and/or trimmed.

A double ended infrared (IR) halogen lamp includes a lamp body and a filament assembly. The lamp body includes a light emitting chamber intermediate sealed end portions. The filament assembly includes a mid portion positioned in the chamber and extending axially through each end portion. The lamp body proximate the each axial end of the chamber is necked down to reduce the inside and outside diameter of the lamp body in the necked down portions.

A double ended infrared (IR) halogen lamp includes a lamp body and a filament assembly positioned in the lamp body. The lamp body includes a light emitting chamber intermediate sealed tubular end portions that have an outside diameter of 4 mm or less and an inside diameter of 2 mm or less.

A double ended infrared (IR) halogen lamp includes a lamp body and a filament assembly. The lamp body has a light emitting chamber intermediate sealed tubular end portions. The filament assembly includes a mid portion and a pair of beads. The mid portion is positioned in the chamber and extending axially through each end portion. Each bead ensheaths a corresponding axial extension in an end portion of the lamp body.

BRIEF DESCRIPTION OF THE DRAWINGS

The following will be apparent from elements of the figures, which are provided for illustrative purposes and are not necessarily to scale.

DETAILED DESCRIPTION

Various embodiments improve upon prior art techniques by reducing end losses and/or increasing IR reflective surface area of halogen lamps, thereby increasing overall lamp efficiency.

Figure 1A:
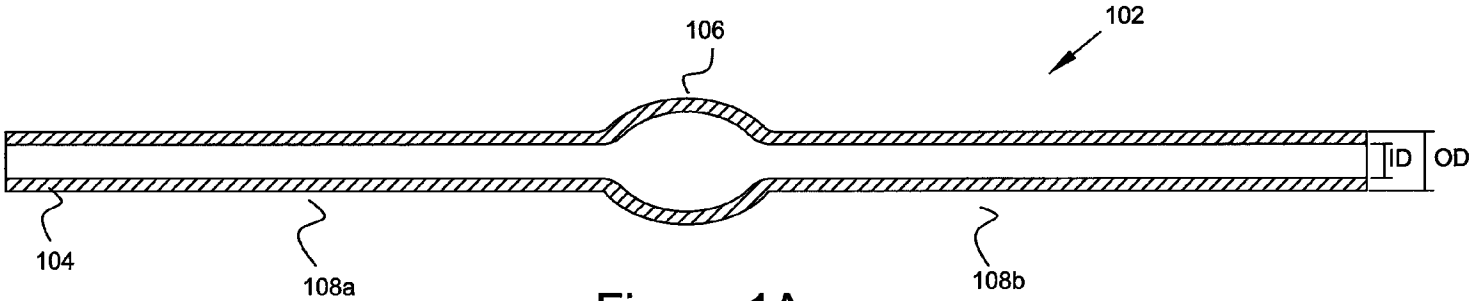
Figure 1A Prior Art
FIGS. 1A-B depict a known halogen lamp.
Figure 1B:
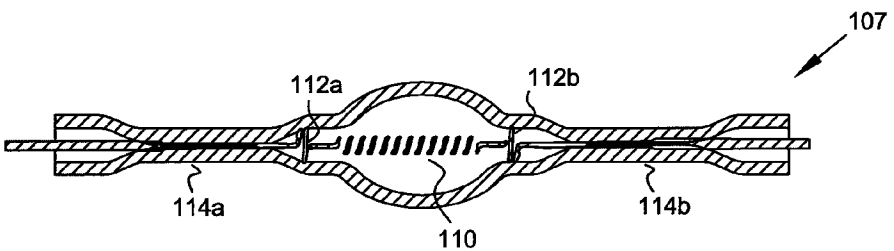
Figure 1B Prior Art
Figure 2A:
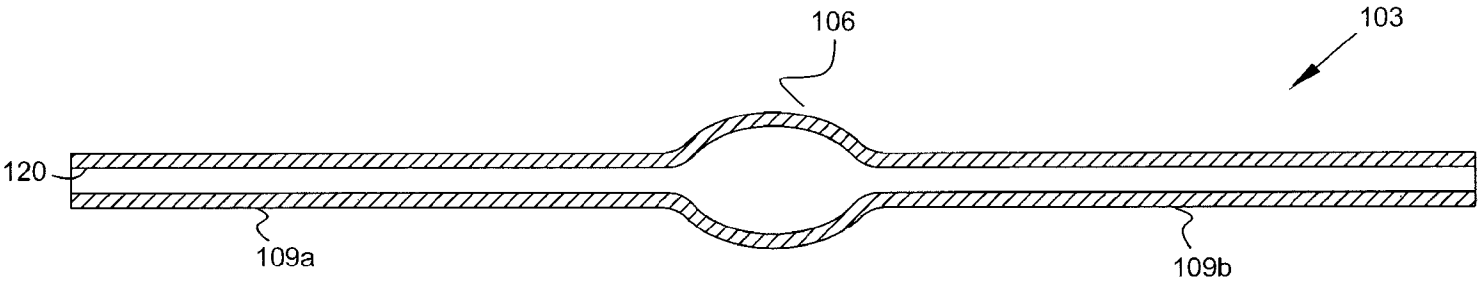
FIGS. 2A-F illustrate components of a double ended infrared (IR) halogen lamp at various stages of processing in accordance with some embodiments.

FIGS. 2A-2F illustrate components of a double ended infrared (IR) halogen lamp at various stages of processing in accordance with some embodiments. FIG. 2A shows a lamp body 103 having a light emitting chamber 106 intermediate (between) tubular end portions 109*a-b* (collectively 109). The chamber 106 may be bulbous, and in some embodiments, the chamber 106 is ellipsoidal or spherical. An outer surface of the chamber 106 may be coated with a coating 151 that reflects IR radiation and transmits visible light. The coating 151 may be a multilayer film that transmits visible radiation (visible light) and reflects IR radiation. Such a film is described in, e.g., U.S. Pat. No. 6,476,556, by Cottaar. The reflected IR energy is reabsorbed by a wire within the chamber, described below, to decrease the power required for lamp operation without reducing the visible radiation output. In some embodiments, the coating 151 is applied to the outer surface of the chamber 106 and extends beyond the necked down portions 134*a-b*. The coating 151 may be applied to the lamp body 103 prior to forming the bulb. Alternatively, the coating 151 may be applied to the lamp body after the bulb is formed.

Figure 2B:
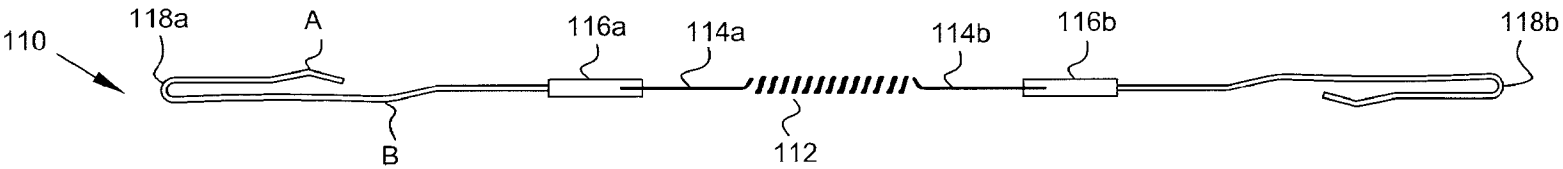

FIG. 2B is an illustration of a filament assembly 110 having a refractory metal wire (filament) 112, which may be a filament made of tungsten. The wire 112 may be coiled, e.g., in a double coiled configuration, at a coiled portion and uncoiled at inlead portions 114*a-b* (collectively 114) as shown in FIG. 2. The coiled portion is a mid (central) portion of the filament assembly 110. Respective distal ends of the uncoiled inlead portions 112 are attached to foils 116*a-b* (collectively 116), which may be molybdenum foils. The filament assembly 110 may have bend portions 118*a-b* (collectively 118) that are attached to respective distal ends of the foils 116 and that form respective distal ends of the assembly. Bend portions 118 are dimensioned to frictionally engage an inner wall 120 of the end portions 109 of the lamp body 103 when the filament assembly 110 is positioned within the lamp body as described below in the context of FIG. 2C. Each bend portion 118 is dimensioned to contact the inner wall of a corresponding end portion 109 at two or more points. For example, the bend portion 118*a* is dimensioned to contact the inner wall 120 at least at points A and B. Each bend portion 118 lies in a single plane in some embodiments. For example, each bend portion 118 may be a reverse bend portion that has shape of a hairpin as in FIG. 2B, curving back towards the mid portion 112. In other embodiments (not shown), each bend portion does not lie in a single plane.

Figure 2C:
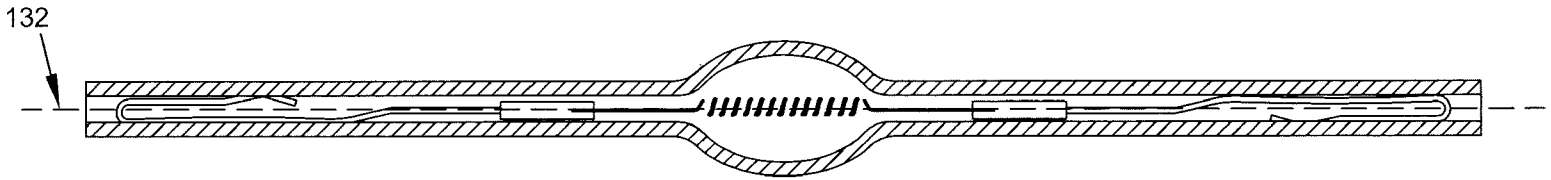
Figure 2D:
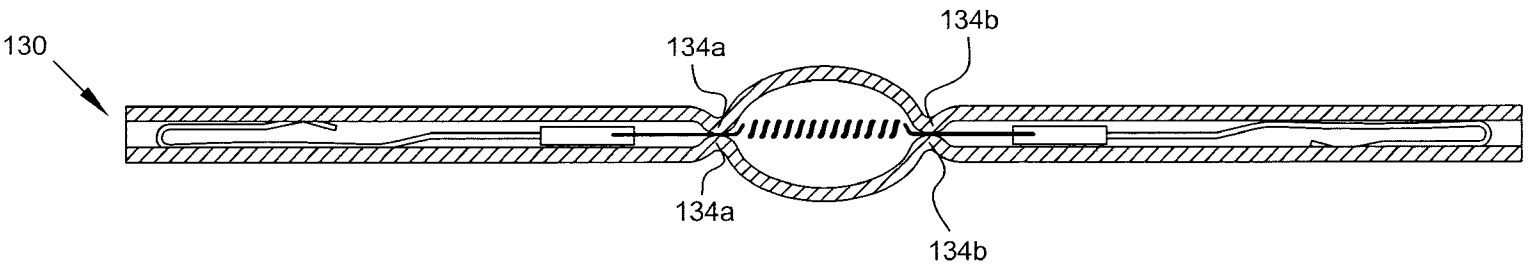

The filament assembly 110 is positioned within the lamp body 103 so that the wire 112 extends from the chamber 106 into each tubular end portion 109. Thus, the mid portion 112, which is a coiled portion in the example of FIGS. 2A-F, is positioned in the chamber 106 and extends axially through each end portion 109. The bend portions 118 frictionally engage the inner wall 120 of the end portions 109 to longitudinally fix the position of the filament assembly 110 within the lamp body 103. In some embodiments, the lamp body 103 having the filament assembly 110 positioned therein as in shown FIG. 2C is "necked down" (necked) to produce a collared assembly 130 as shown in FIG. 2D. In one embodiment, the lamp body 103 is necked down at the desired portions by rotating it about its longitudinal axis 132. A portion 134*a* of one of the end portions 109, e.g., end portion 109*a*, at an axial end of the chamber 106 (i.e., an end of the chamber along the longitudinal axis) is heated. The heated portion 134*a* is necked down using a disc (not shown) having a rotational axis parallel to the longitudinal axis 132 of the lamp body 103 which may move along a radius of the lamp body. The peripheral edge of the disc is contacted with the outer surface of the end portion 109*a* and moved inward along a radius of the end portion toward the longitudinal axis 132, thereby reducing the inside and outside diameters of the end portion 109*a* at the desired location. The disc may be controlled by a stepper motor, as is known to one of ordinary skill in the art. The heated portion 134*a* may be necked down sufficiently to assist in maintaining the position of the filament wire along the longitudinal axis 132 of the lamp body.

A portion 134*b* of the other end portion 109*b* is heated, and the heated portion 134*b* is necked down as described above regarding necked down portion 134*a*. The heated portion 134*b* may be necked down sufficiently to assist in maintaining the position of the filament wire along the longitudinal axis 132 of the lamp body.

Figure 2E:
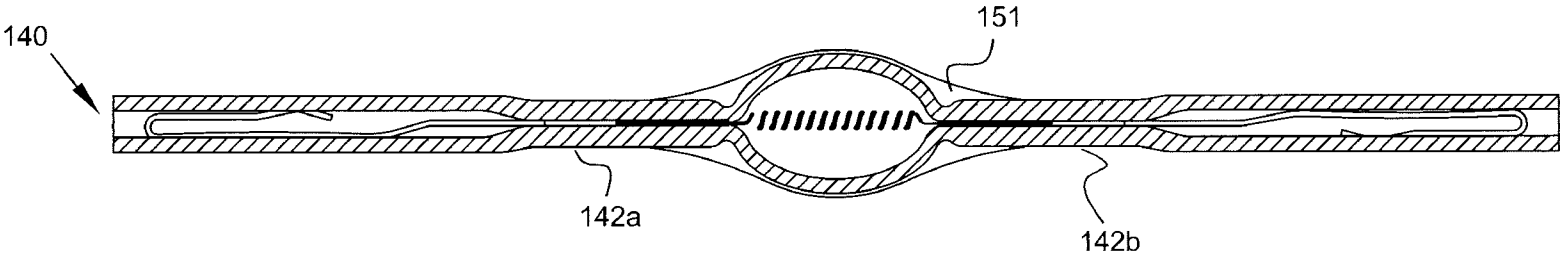

In some embodiments, while the collared assembly 130 is still spinning, one of the end portions, e.g., end portion 109*a*, is hermetically sealed, e.g., by shrink sealing the end portion on the lathe as is known to one of ordinary skill in the art. The other end portion 109*b* may be sealed in a like manner. Thus, a collared burner 140 with sealed end portions 142*a-b* is produced as shown in FIG. 2E.

Figure 2F:
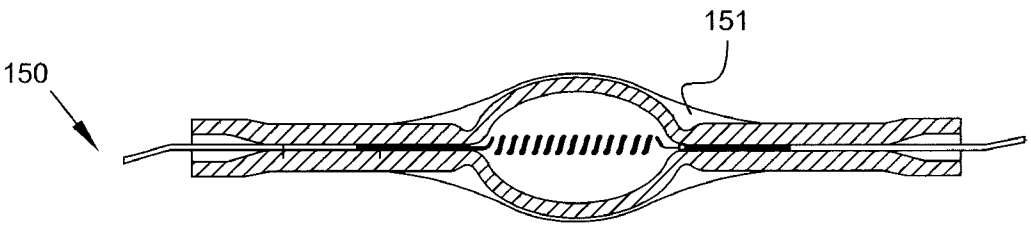
Figure 5:
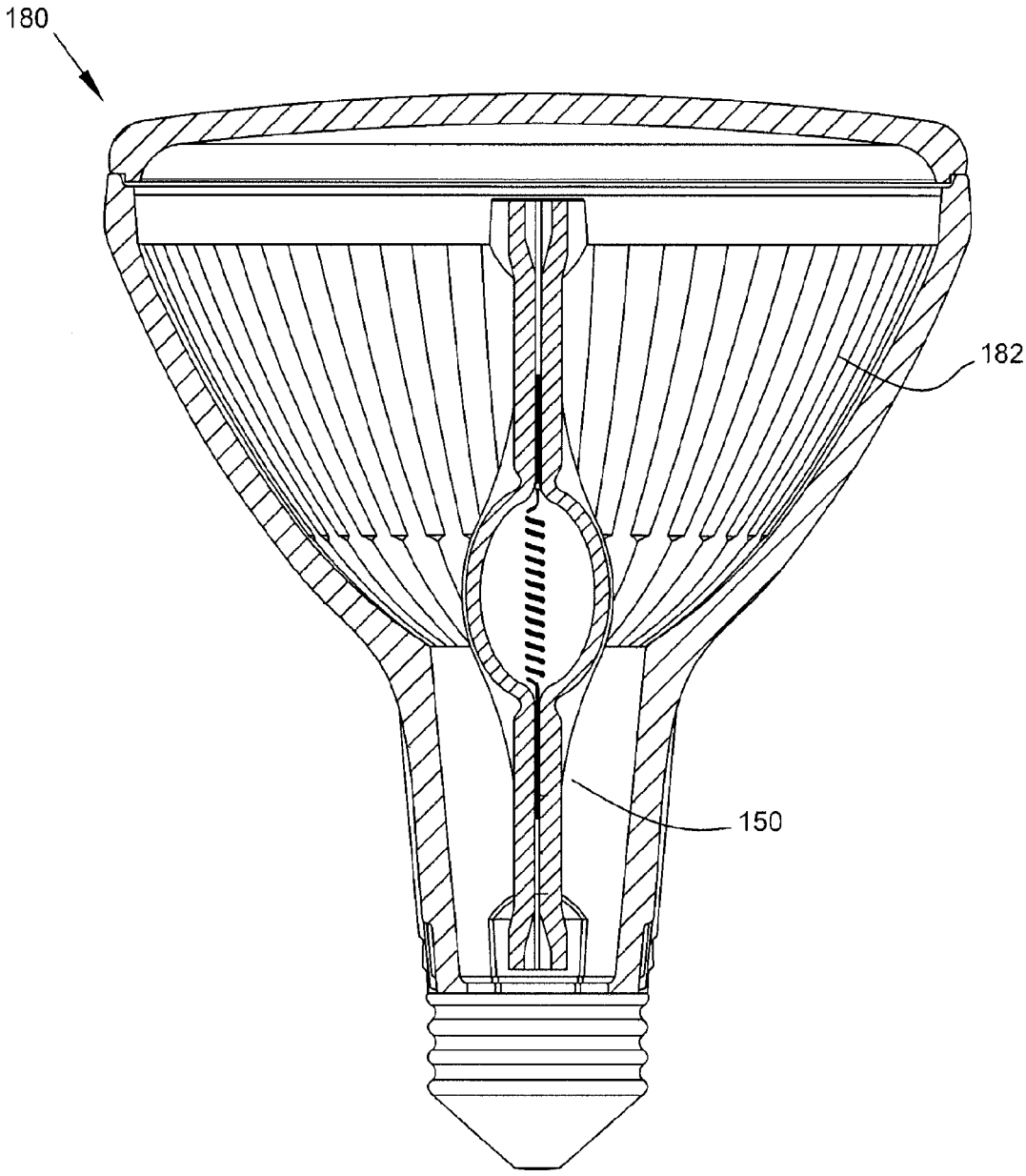
FIG. 5 is an illustration of a lamp made in accordance with some embodiments employing necking down.

As shown in FIG. 2F, the collared burner 140 is trimmed at both ends to produce a trimmed burner 150. The trimmed burner 150 is ready for finishing, e.g., for installation in a housing as shown in FIG. 5.

Necking down the end portions according to some embodiments centers the filament assembly 110 in the chamber 106, i.e., ensures that the mid portion 112 of the wire is positioned along the longitudinal axis 132. Necking down the lamp body also advantageously increases efficiency by allowing more IR radiation to be reflected back to the filament 112 than with prior art IR halogen lamps. Such an efficiency gain is enabled because, as shown in FIG. 2D, necking down the lamp body reduces the diameter of the lamp body 103 at the necked down portions 134*a-b*, thereby increasing the surface area of chamber 106 available for IR reflection. Furthermore, necking down the lamp body reduces end losses to increase efficiency further, because respective conduits from the interior of the chamber 106 into respective interiors of the tubular end portions 109 are narrowed at the necked down portions 134*a-b*.

In some embodiments, each end portion 109 includes an inner diameter less than 4 mm. The outer diameter of each end portion 109 may be less than 5 mm. In some embodiments, the inner and outer diameters of the end portions 109 may be 2 mm or less and 4 mm or less, respectively. It had been discovered that by forming the lamp body from tubes having reduced diameters (inner and outer diameters) relative to typical 5 mm OD tubes used in the prior art increases efficiency by lowering end losses and increasing the surface area of the IR coating 151 on the chamber 106.

Figure 3A:
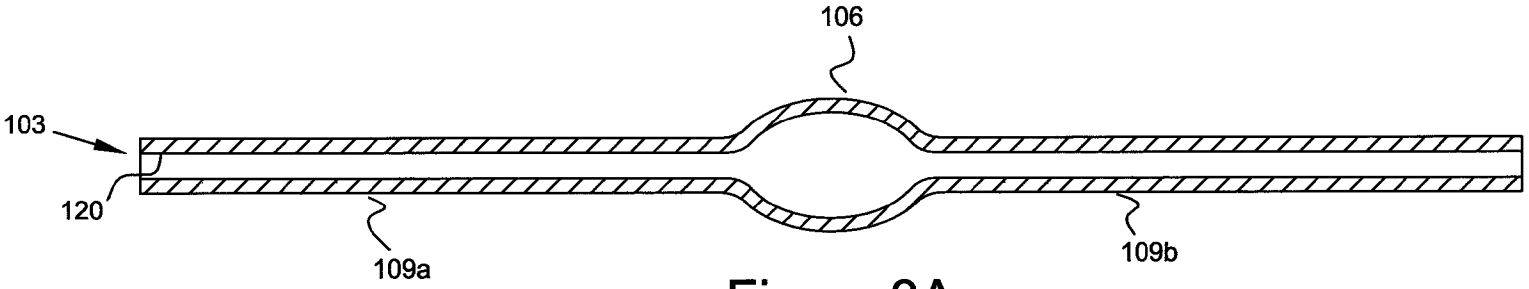
FIGS. 3A-E show components of a double ended IR halogen lamp at various stages of processing in accordance with some embodiments utilizing spuds.
Figure 3B:
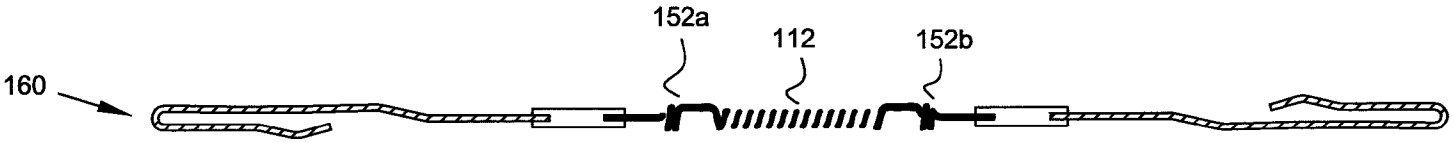
Figure 3C:
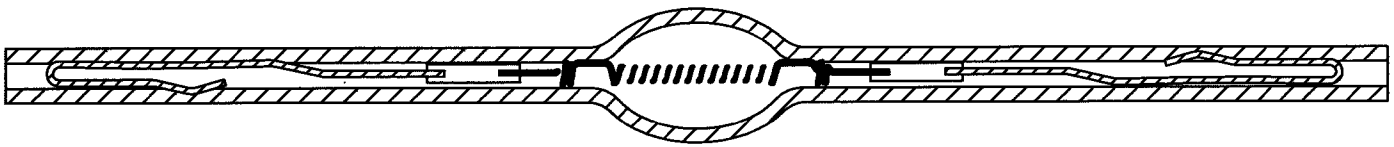
Figure 3D:
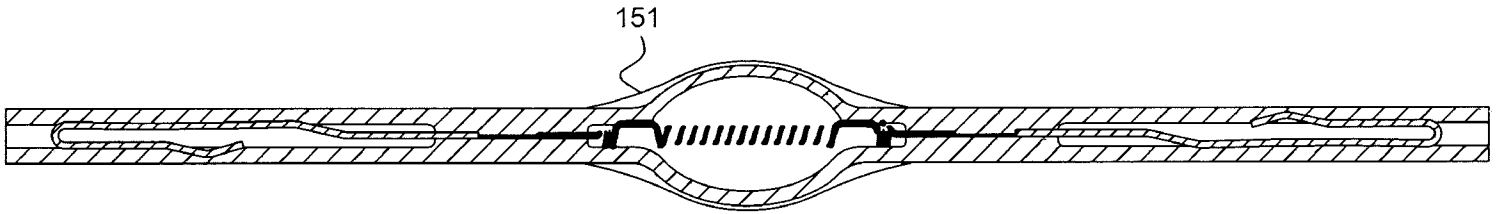
Figure 3E:
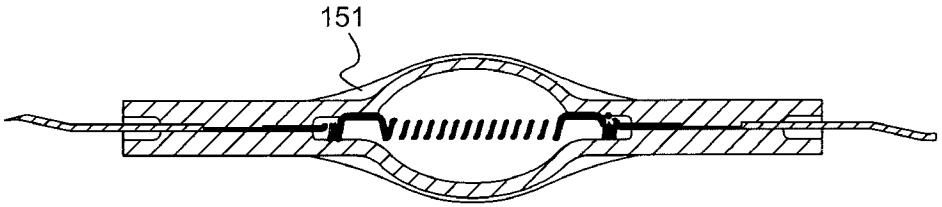

FIGS. 3A-E show components of a double ended IR halogen lamp at various stages of processing in accordance with some embodiments utilizing spuds to assist in positioning the filament. FIG. 3A is an illustration of a lamp body 103 having a chamber 106 and the end portions 109. As shown in FIG. 3B, the filament assembly 160 includes a mid portion 112 of a filament, which may be a coiled portion, and spuds 152*a-b* (collectively 152). The mid portion 112 is positioned in the chamber 106, as shown in FIG. 3C, and extends axially through each end portion 109. Each spud 152 has the shape of a ring having an outside diameter equal to the inside diameter of a corresponding end portion 109 of the lamp body 103 so that spuds 152 contact the inner wall 120 of the end portions. Thus, when the filament assembly 160 is positioned within the lamp body 103, the spuds 152 support respective end portions 109. Thus, the spuds 152 assist in positioning the filament in the chamber 106 along the longitudinal axis of the lamp body 103. The spuds 152 according to one embodiment are smaller (have a smaller ring diameter) than the prior art spuds which leads to increased efficiency by enabling increased surface area of the IR coating 151 of chamber 106.

Figure 4A:
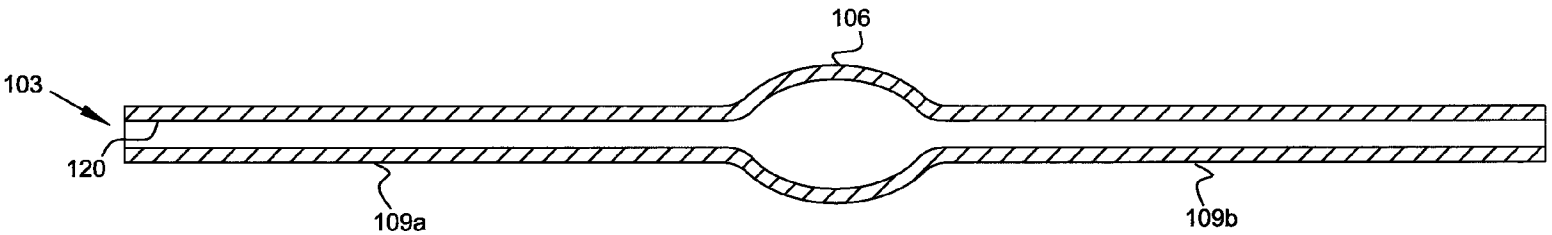
FIGS. 4A-E show components of a double ended IR halogen lamp at various stages of processing in accordance with some embodiments utilizing beads.
Figure 4B:
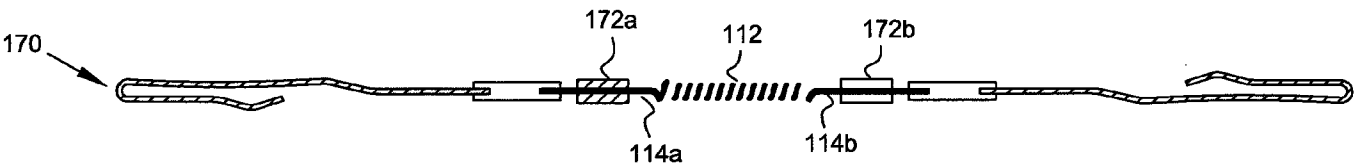
Figure 4C:
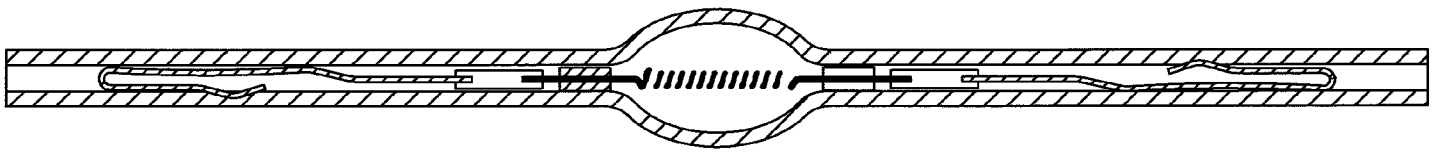
Figure 4D:
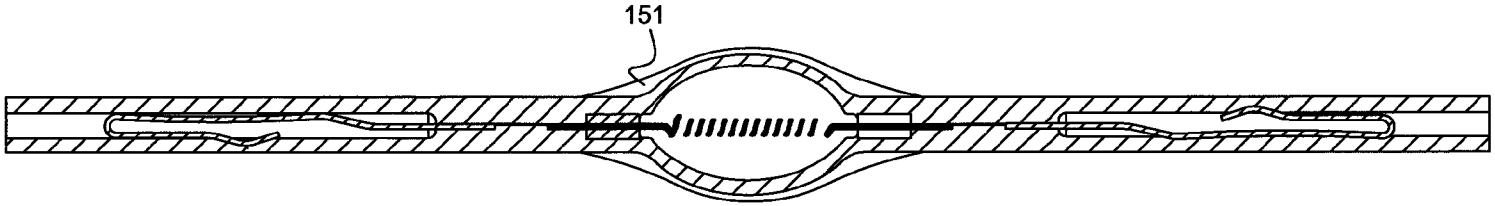
Figure 4E:
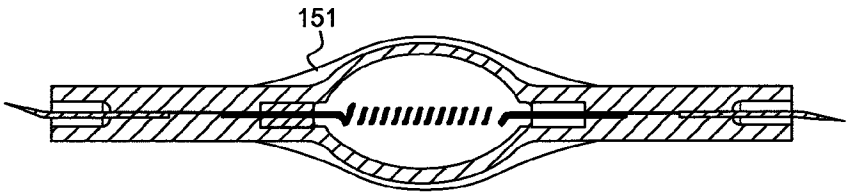

FIGS. 4A-E show components of a double ended IR halogen lamp at various stages of processing in accordance with some embodiments utilizing beads to assist in positioning the filament. FIG. 4A is an illustration of a lamp body 103 having a chamber 106 and end portions 109. As shown in FIG. 4B, the filament assembly 170 includes a mid portion 112 of a filament, which may be a coiled portion, and beads 172*a-b* (collectively 172). The mid portion 112 is positioned in the chamber 106, as shown in FIG. 4C, and extends axially through each end portion 109. The beads may have any suitable shape such as spherical or cylindrical. According to the illustrated embodiment, each of the beads 172 may be a cylindrical bead of a vitreous, light transmissive material, e.g., glass or quartz. Each of the beads 172 defines a central opening through which a corresponding uncoiled inlead portion of the filament assembly is passed. The beads 172 are dimensioned to contact the inner wall 120 of a corresponding end portion 109 to assist in positioning the filament in the chamber 106 along the longitudinal axis of lamp body 109.

FIG. 5 is an illustration of a lamp made in accordance with some embodiments employing necking down, e.g., as in FIG. 2F. The lamp 180 includes a trimmed burner 150 in a parabolic aluminized reflector (PAR) housing 182. Such a housing is known to one of ordinary skill in the art. The lamp 180 may be a 12 V lamp having a PAR30 sizing, i.e., a 3.75 inch diameter; other sizes and voltages may be used as well.

Although examples are illustrated and described herein, embodiments are nevertheless not limited to the details shown, since various modifications and structural changes may be made therein by those of ordinary skill within the scope and range of equivalents of the claims.

What is claimed is:

1. A double ended infrared (IR) halogen lamp comprising:
- a lamp body having a light emitting chamber intermediate sealed tubular end portions; and
- a filament assembly including:
  - a refractory metal wire positioned in said chamber and extending axially through each of said end portions;
  - a pair of metal foils, each foil being connected at a respective distal end of said wire; and
  - a pair of beads, each bead ensheathing a portion of said wire extending in an end portion of said lamp body, said beads being positioned interior of and spaced from said metal foil connected to the distal end of said wire.

2. The lamp of claim 1 wherein said beads are cylindrical or spherical.

3. The lamp of claim 2 wherein said beads have a diameter of 2 mm or less.

4. The lamp of claim 1 wherein said beads are formed from glass or quartz.

5. A double-ended infrared halogen lamp comprising:
- a lamp body formed from quartz having a light emitting chamber intermediate a pair of sealed end portions; and
- a filament assembly including:
  - a refractory metal wire positioned in said chamber and extending axially through each of said end portions;
  - a pair of metal foils, each foil being connected at a respective distal end of said wire;
- wherein each of said sealed end portions being hermetically sealed around a metal foil and at least a portion of the refractory wire of said filament assembly; and
- wherein said lamp body comprises a pair of necked down portions having an inner wall in contact with said filament assembly, each of said necked down portions being positioned between said chamber and a respective sealed end portion, said necked down portions having a lateral dimension smaller than any lateral dimension of said sealed end portion proximate thereto.

6. The lamp of claim 5 wherein each necked down portion has a generally circular cross section.

7. The lamp of claim 5 further comprising an IR reflective coating on an outer surface of the lamp body forming said light emitting chamber.

8. The lamp of claim 7 wherein said IR reflective coating covers the outer surface of the lamp body in an area extending from the longitudinal center of the lamp body beyond each necked down portion of said body.

9. The lamp of claim 5 wherein said light emitting chamber is ellipsoidal or spherical.

10. The lamp of claim 5 wherein the end portions comprise tubular portions having an outside diameter of 5 mm or less.

11. The lamp of claim 10 wherein the end portions comprise tubular portions having an outside diameter of 4 mm or less.

* * * * *